US007733303B2

(12) United States Patent
Cho et al.

(10) Patent No.: US 7,733,303 B2
(45) Date of Patent: Jun. 8, 2010

(54) PLASMA DISPLAY APPARATUS AND METHOD OF DRIVING THE SAME

(75) Inventors: Janghwan Cho, Seoul (KR); Hyunil Park, Seongnam-si (KR); Changjoon Park, Seoul (KR); Sunghwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 497 days.

(21) Appl. No.: 11/854,415

(22) Filed: Sep. 12, 2007

(65) Prior Publication Data

US 2008/0062079 A1 Mar. 13, 2008

(30) Foreign Application Priority Data

Sep. 12, 2006 (KR) ..... 10-2006-0088311

(51) Int. Cl.
*G09G 3/28* (2006.01)

(52) U.S. Cl. ..... 345/63; 345/60

(58) Field of Classification Search ..... 345/63, 345/60, 66; 315/169.4; 313/567
See application file for complete search history.

(56) References Cited

U.S. PATENT DOCUMENTS 6,160,529 A * 12/2000 Asao et al. ..... 345/60
6,525,701 B1 * 2/2003 Kang ..... 345/60
6,987,495 B2 * 1/2006 Wakabayashi et al. ..... 345/63
2002/0044107 A1 * 4/2002 Lee ..... 345/60
2006/0061523 A1 3/2006 Kim et al.
2006/0103325 A1 5/2006 Kim

FOREIGN PATENT DOCUMENTS

EP 1 580 714 A2 9/2005
EP 1 622 118 A2 2/2006
KR 10-2005-0112851 A 12/2005
KR 10-2006-0019859 A 3/2006

* cited by examiner

*Primary Examiner*—Ricardo L Osorio
(74) *Attorney, Agent, or Firm*—Birch, Stewart, Kolasch & Birch, LLP.

(57) ABSTRACT

A plasma display apparatus and a method of driving the same are disclosed. In the method, a first pulse of a positive polarity direction and a second pulse of a negative polarity direction are alternately supplied to the first electrode during a sustain period. In this case, an absolute value of a voltage of the first pulse is different from an absolute value of a voltage of the second pulse. A third pulse of a positive polarity direction to the third electrode is supplied during the supply of the first pulse, and a fourth pulse having a sum of a voltage magnitude of the third pulse and a voltage magnitude of the second pulse is supplied to the third electrode during the supply of the second pulse.

18 Claims, 4 Drawing Sheets

PLASMA DISPLAY APPARATUS AND METHOD OF DRIVING THE SAME

This application claims the benefit of Korean Patent Application No. 10-2006-0088311 filed on Sep. 12, 2006, which is hereby incorporated by reference.

BACKGROUND OF THE DISCLOSURE

1. Field of the Disclosure

This document relates to a plasma display apparatus and a method of driving the same.

2. Description of the Background Art

A plasma display apparatus generally includes a plasma display panel displaying an image, and a driver attached to the rear of the plasma display panel to drive the plasma display panel.

The plasma display panel has the structure in which barrier ribs formed between a front substrate and a rear substrate form unit discharge cell or discharge cells. Each discharge cell is filled with an inert gas containing a main discharge gas such as neon (Ne), helium (He) or a mixture of Ne and He, and a small amount of xenon (Xe). The plurality of discharge cells form one pixel. For instance, a red (R) discharge cell, a green (G) discharge cell, and a blue (B) discharge cell form one pixel.

When the plasma display panel is discharged by a high frequency voltage, the inert gas generates vacuum ultraviolet rays, which thereby cause phosphors formed between the barrier ribs to emit light, thus displaying an image.

The plasma display panel includes a scan electrode, a sustain electrode, and an address electrode. Each driver is connected to the corresponding electrode to supply a driving voltage to the corresponding electrode. The drivers supply a driving pulse such as a reset pulse, a scan pulse and a sustain pulse to these electrodes during a reset period, an address period, and a sustain period when the plasma display panel is driven, thereby emitting light in discharge cells.

SUMMARY OF THE DISCLOSURE

This document provides a plasma display apparatus and a method of driving the same capable of maintaining the uniformity of the quantity of light by reducing a difference between the quantity of light generated by the supply of a positive sustain voltage and the quantity of light generated by the supply of a negative sustain voltage during a sustain period.

A method of driving a plasma display apparatus including a first electrode, a second electrode, and a third electrode positioned in an intersection direction of the first electrode and the second electrode, the method comprises alternately supplying a first pulse of a positive polarity direction and a second pulse of a negative polarity direction to the first electrode during a sustain period, an absolute value of a voltage of the first pulse being different from an absolute value of a voltage of the second pulse, and supplying a third pulse of a positive polarity direction to the third electrode during the supply of the first pulse and supplying a fourth pulse having a sum of a voltage magnitude of the third pulse and a voltage magnitude of the second pulse to the third electrode during the supply of the second pulse.

A difference between the absolute value of the voltage of the first pulse and an absolute value of a voltage of the third pulse may be substantially equal to a difference between the absolute value of the voltage of the second pulse and an absolute value of a voltage of the fourth pulse.

The absolute value of the voltage of the first pulse may be substantially two times the absolute value of the voltage of the third pulse.

The absolute value of the voltage of the third pulse may be substantially equal to a voltage of a data pulse supplied to the third electrode during an address period.

A highest voltage of the third pulse may be a voltage obtained by the clamping of the third electrode, and the voltage of the fourth pulse may be a voltage obtained by the floating of the third electrode.

The absolute value of the voltage of the first pulse may be two times a voltage of a data pulse supplied to the third electrode during an address period.

The absolute value of the voltage of the first pulse may be smaller than the absolute value of the voltage of the second pulse. The absolute value of the voltage of the third pulse of the positive polarity direction may be one half of the absolute value of the voltage of the first pulse.

A highest voltage of the third pulse may be a voltage obtained by the clamping of the third electrode, and the voltage of the fourth pulse may be a voltage obtained by the floating of the third electrode, A highest voltage of the third pulse may be a voltage obtained by the clamping of the third electrode, and the voltage of the fourth pulse may be a voltage obtained by the floating of the third electrode.

A plasma display apparatus comprises a plasma display panel including a first electrode, a second electrode, and a third electrode positioned in an intersection direction of the first electrode and the second electrode, a single sustain driver that alternately supplies a first pulse of a positive polarity direction and a second pulse of a negative polarity direction to the first electrode during a sustain period, an absolute value of a voltage of the first pulse being different from an absolute value of a voltage of the second pulse, an address driver that supplies a third pulse of a positive polarity direction to the third electrode during the supply of the first pulse, and a ground separation controller that switches on or off between a first ground voltage source connected to the single sustain driver and a second ground voltage source connected to the address driver, and controls the supply of the third pulse to the third electrode during the supply of the first pulse and the supply of a fourth pulse having a sum of a voltage magnitude of the third pulse and a voltage magnitude of the second pulse to the third electrode during the supply of the second pulse.

A difference between the absolute value of the voltage of the first pulse and an absolute value of a voltage of the third pulse may be substantially equal to a difference between the absolute value of the voltage of the second pulse and an absolute value of a voltage of the fourth pulse.

The absolute value of the voltage of the first pulse may be substantially two times the absolute value of the voltage of the third pulse.

The absolute value of the voltage of the third pulse may be substantially equal to a voltage of a data pulse supplied to the third electrode during an address period.

When the ground separation controller is turned on, a voltage level of the third electrode may be clamped to a highest voltage of the third pulse. When the ground separation controller is turned off, a voltage level of the third electrode may be floated to the voltage of the fourth pulse.

The absolute value of the voltage of the first pulse may be two times a voltage of a data pulse supplied to the third electrode during an address period.

The absolute value of the voltage of the first pulse may be smaller than the absolute value of the voltage of the second pulse. The absolute value of the voltage of the third pulse of the positive polarity direction may be one half of the absolute value of the voltage of the first pulse.

When the ground separation controller is turned on, a voltage level of the third electrode may be clamped to a highest voltage of the third pulse. When the ground separation controller is turned off, a voltage level of the third electrode may be floated to the voltage of the fourth pulse.

When the ground separation controller is turned on, a voltage level of the third electrode may be clamped to a highest voltage of the third pulse. When the ground separation controller is turned off, a voltage level of the third electrode may be floated to the voltage of the fourth pulse.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Reference will now be made in detail embodiments of the invention examples of which are illustrated in the accompanying drawings.

Figure 1:
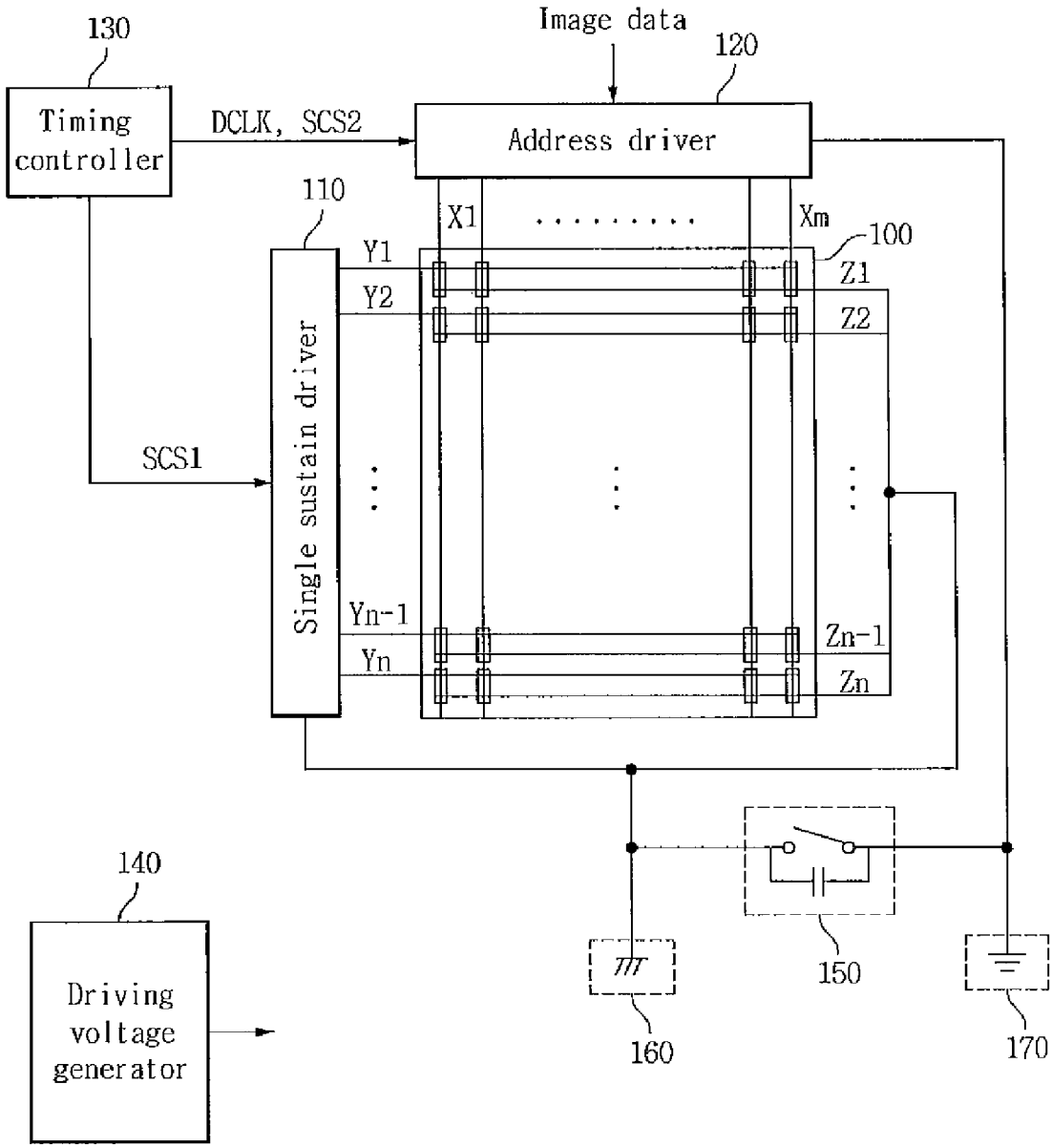
FIG. 1 schematically illustrates a plasma display apparatus according to an exemplary embodiment.

FIG. 1 schematically illustrates a plasma display apparatus according to an exemplary embodiment.

As illustrated in FIG. 1, the plasma display apparatus according to an exemplary embodiment includes a plasma display panel 100, a single sustain driver 110, an address driver 120, a timing controller 130, a driving voltage generator 140, and a ground separation controller 150.

The plasma display panel 100 includes first electrodes Y1 to Yn and second electrodes Z1 to Zn that are arranged in a row direction, and third electrodes X1 to Xm that that are arranged in a column direction to intersect the first electrodes Y1 to Yn and the second electrodes Z1 to Zn.

The single sustain driver 110 supplies a reset pulse and a scan pulse to the first electrodes Y1 to Yn in response to a first switching control signal SCS1 output from the timing controller 130.

The single sustain driver 110 alternately supplies a sustain pulse of a positive polarity direction (hereinafter, referred to as a first pulse) and a sustain pulse of a negative polarity direction (hereinafter, referred to as a second pulse) to the first electrodes Y1 to Yn during a sustain period. In this case, an absolute value of a voltage of the first pulse is different from an absolute value of a voltage of the second pulse.

The absolute value of the voltage of the first pulse may be substantially two times a voltage of a third pulse supplied to the third electrodes X1 to Xm during an address period, and may be substantially two times the voltage of the third pulse supplied to the third electrodes X1 to Xm during the sustain period.

The address driver 120 supplies image data supplied from the outside to the third electrodes X1 to Xm in response to data clock DCLK and a second switching control signal SCS2 output from the timing controller 130.

The address driver 120 supplies the third pulse of a positive polarity direction to the third electrodes X1 to Xm during the supply of the first pulse.

The sustain electrodes Z1 to Zn and the single sustain driver 110 are connected to a first ground voltage source 160. Hence, when the single sustain driver 110 supplies the second pulse to the first electrodes Y1 to Yn, a voltage of the sustain electrodes Z1 to Zn connected to the first ground voltage source 160 is maintained at a ground level voltage. In other words, a driver for driving the sustain electrodes Z1 to Zn is not necessary. Accordingly, the fabrication cost of the plasma display apparatus is reduced.

The timing controller 130 generates various switching control signals to generate a predetermined driving waveform, and supplies the various switching control signals to the single sustain driver 110 and the address driver 120. For instance, the timing controller 130 generates the first switching control signal SCS1 to supply it to the single sustain driver 110, and generates the second switching control signal SCS2 and the data clock DCLK to supply them to the address driver 120.

The driving voltage generator 140 generates various driving voltages to generate a predetermined driving waveform, and supplies the various driving voltages to the single sustain driver 110 and the address driver 120.

The ground separation controller 150 switches on or off between the first ground voltage source 160 connected to the single sustain driver 110 and a second ground voltage source 170 connected to the address driver 120. The ground separation controller 150 includes a circuit in which a switch and a capacitor are connected in parallel.

When the ground separation controller 150 is turned on, the third pulse is supplied to the third electrodes X1 to Xm during the supply of the first pulse to the first electrodes Y1 to Yn. When the ground separation controller 150 is turned off, a fourth pulse having a sum of a voltage magnitude of the third pulse and a voltage magnitude of the second pulse is supplied to the third electrodes X1 to Xm due to a floating effect during the supply of the second pulse to the first electrodes Y1 to Yn.

Figure 2:
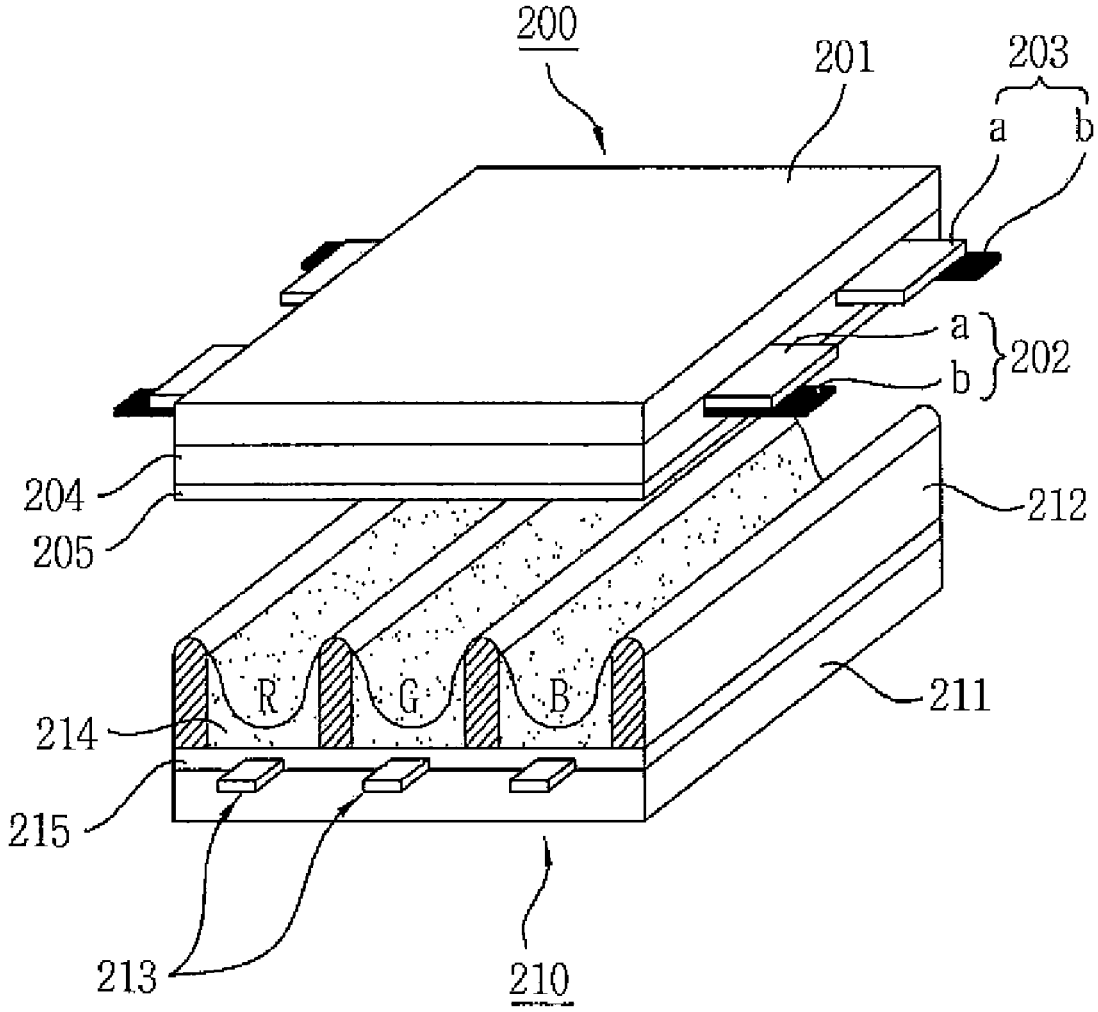
FIG. 2 illustrates a structure of a plasma display panel of FIG. 1.

FIG. 2 illustrates a structure of the plasma display panel 100 of FIG. 1.

As illustrated in FIG. 2, the plasma display panel 100 includes a front panel 200 and a rear panel 210 which are coupled parallel to each other to oppose to each other at a given distance therebetween. The front panel 200 includes a front substrate 201 being a display surface on which an image is displayed. The rear panel 210 includes a rear substrate 211 constituting a rear surface. A plurality of first electrodes 202 and a plurality of second electrodes 203 are formed in pairs on the front substrate 201. A plurality of third electrodes 213 are arranged on the rear substrate 211 to intersect the first electrodes 202 and the second electrodes 203.

The first electrode 202 and the second electrode 203 each include transparent electrodes 202*a* and 203*a* made of a transparent material, for instance, indium-tin-oxide (ITO) and bus electrodes 202*b* and 203*b* made of a metal material. The first electrode 202 and the second electrode 203 generate a mutual discharge therebetween in one discharge cell and maintain light-emissions of the discharge cells.

The first electrode 202 and the second electrode 203 are covered with one or more upper dielectric layers 204 for limiting a discharge current and providing electrical insulation between the first electrode 202 and the second electrode 203. A protective layer 205 with a deposit of MgO is formed on an upper surface of the upper dielectric layer 204 to facilitate discharge conditions.

A plurality of stripe-type (or well-type) barrier ribs 212 are formed in parallel on the rear substrate 211 to form a plurality of discharge spaces (i.e., a plurality of discharge cells). The plurality of third electrodes 213 for performing an address discharge to generate vacuum ultraviolet rays are arranged parallel to the barrier ribs 212.

An upper surface of the rear substrate 211 is coated with red (R), green (G) and blue (B) phosphors 214 for emitting visible light for an image display during the generation of an address discharge. A lower dielectric layer 215 is formed between the third electrodes 213 and the phosphors 214 to protect the third electrodes 213.

FIG. 2 illustrated only an example of the plasma display panel 100 applicable to an exemplary embodiment. Accordingly, an exemplary embodiment is not limited to the structure of the plasma display panel illustrated in FIG. 2.

For instance, in FIG. 2, the first electrode 202 and the second electrode 203 each include the transparent electrodes 202*a* and 203*a* and the bus electrodes 202*b* and 203*b*. However, at least one of the first electrode 202 and the second electrode 203 may include only the bus electrode.

Further, FIG. 2 illustrated the upper dielectric layer 204 having a constant thickness. However, the upper dielectric layer 204 may have a different thickness and a different dielectric constant in each area. FIG. 2 illustrated the barrier ribs 212 having a constant interval between the barrier ribs. However, an interval between the barrier ribs 112 forming the blue discharge cell (B) may be larger than intervals between the barrier ribs 112 forming the red and green discharge cells (R and G).

Further, a luminance of an image displayed on the plasma display panel 100 can increase by forming the side of the barrier rib 112 in a concavo-convex shape and coating the phosphor 214 depending on the concavo-convex shape of the barrier rib 112.

A tunnel may be formed on the side of the barrier rib 112 so as to improve an exhaust characteristic when the plasma display panel is fabricated.

Figure 3:
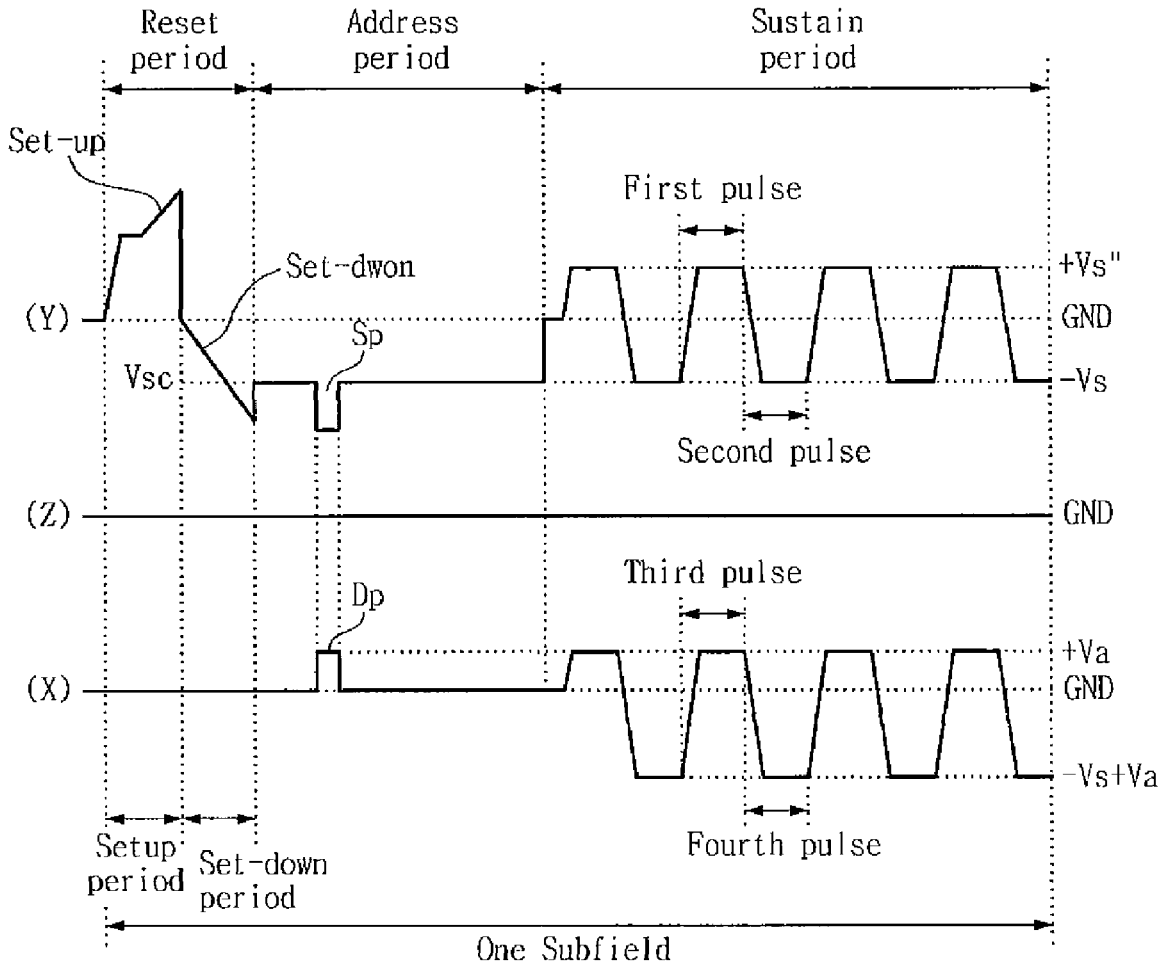
FIG. 3 illustrates a driving waveform supplied to a plasma display panel according to an exemplary embodiment.

FIG. 3 illustrates a driving waveform supplied to a plasma display panel according to an exemplary embodiment.

As illustrated in FIG. 3, the plasma display apparatus supplies driving pulses to the electrodes X1 to Xm, Y1 to Yn, and Z1 to Zn, with each subfield being divided into a reset period for initializing all the discharge cells of the plasma display panel, an address period for selecting cells to be discharged, and a sustain period for maintaining discharges of the selected cells, thereby displaying an image.

The reset period is further divided into a setup period and a set-down period. During the setup period, a setup pulse (Set-up) is supplied to the first electrode Y, thereby generating a weak dark discharge inside the discharge cells. During the set-down period, a set-down pulse (Set-down) which falls from a voltage of the setup pulse (Set-up) to a given voltage level is supplied to the first electrode Y, thereby generating a weak erase discharge within the discharge cells. Furthermore, the remaining wall charges are uniform inside the cells to the extent that the address discharge can be stably performed.

During the address period, a scan pulse (Sp) of a negative polarity falling from a scan reference voltage Vsc is applied to the first electrode Y and at the same time, a data pulse (Dp) of a positive polarity corresponding to the scan pulse (Sp) is applied to the third electrode X. As the voltage difference between the scan pulse (Sp) and the data pulse (Dp) is added to the wall voltage generated during the reset period, an address discharge occurs within the discharge cells to which the data pulse (Dp) is applied. Wall charges are formed inside the discharge cells selected by performing the address discharge to the extent that when a sustain voltage is applied a sustain discharge occurs.

During the sustain period, the first pulse and the second pulse are alternately supplied to the first electrode Y, and a voltage of the second electrode Z is maintained at a ground level voltage GND due to a ground voltage source. The first pulse rises from a negative sustain voltage −Vs to a positive sustain voltage +Vs", and then is maintained at the positive sustain voltage +Vs" during a predetermined time period. The second pulse falls from the positive sustain voltage +Vs" to the negative sustain voltage −Vs, and then is maintained at the negative sustain voltage −Vs during a predetermined time period.

The third pulse of the positive polarity direction is supplied to the third electrode X during the supply of the first pulse to the first electrode Y, and the fourth pulse having a sum of the voltage magnitude of the third pulse and the voltage magnitude of the second pulse is supplied to the third electrode X during the supply of the second pulse to the first electrode Y.

A difference between the quantity of light generated by the supply of the positive sustain voltage +Vs" and the quantity of light generated by the supply of the negative sustain voltage −Vs is reduced by setting a difference between an absolute value of the voltage +Vs" of the first pulse and an absolute value of the voltage Va of the third pulse to be equal to a difference between an absolute value of the voltage −Vs of the second pulse and an absolute value of a voltage (−Vs+Va) of the fourth pulse. Hence, the uniformity of the quantity of light can be maintained.

Although it is not shown in the drawings, an erase period may be added after the sustain period. During the erase period, charges accumulated on the first electrode or the second electrode after a sustain discharge can be erased.

Figure 4:
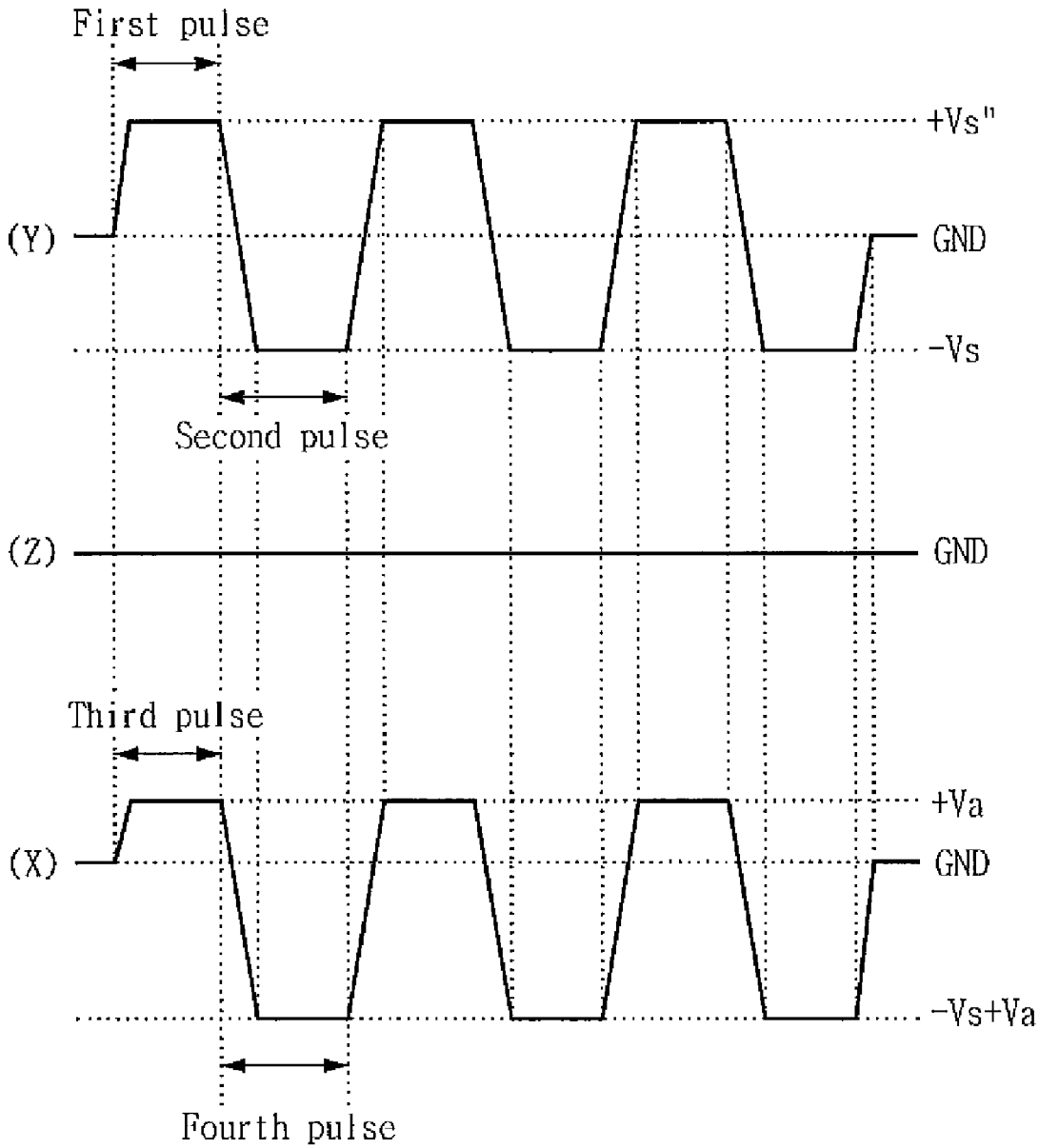
FIG. 4 illustrates a driving waveform supplied to the plasma display panel during a sustain period of FIG. 3.

FIG. 4 illustrates a driving waveform supplied to the plasma display panel during a sustain period of FIG. 3.

As illustrated in FIG. 4, during a sustain period, the first pulse of the positive polarity direction and the second pulse of the negative polarity direction are alternately supplied to the first electrode Y, and an absolute value of the positive sustain voltage +Vs" of the first pulse is different from an absolute value of the negative sustain voltage −Vs of the second pulse.

A difference between the quantity of light generated by the supply of the positive sustain voltage +Vs" and the quantity of light generated by the supply of the negative sustain voltage −Vs is reduced by setting a difference between an absolute value of the voltage +Vs" of the first pulse and an absolute value of the voltage Va of the third pulse to be substantially equal to a difference between an absolute value of the voltage −Vs of the second pulse and an absolute value of the voltage (−Vs+Va) of the fourth pulse. Hence, the uniformity of the quantity of light can be maintained.

More specifically, when the absolute value of the voltage +Vs" of the first pulse is two times the absolute value of the voltage Va of the third pulse, the absolute value of the voltage +Vs" of the first pulse is 2Va, a difference between an absolute value of the voltage 2Va of the first pulse and an absolute value of the voltage Va of the third pulse is Va, and a difference between the absolute value of the voltage −Vs of the second pulse and the absolute value of the voltage (−Vs+Va) of the fourth pulse is va. Hence, the two differences have an equal value.

A separate driver for supplying the third pulse is not necessary by setting the absolute value of the voltage Va of the third pulse to be substantially equal to a voltage of the data pulse supplied to the third electrode X during the address period.

The third pulse of the positive polarity direction is supplied to the third electrode X during the supply of the first pulse to the first electrode Y, and the fourth pulse having a sum of the voltage magnitude of the third pulse and the voltage magnitude of the second pulse is supplied to the third electrode X during the supply of the second pulse to the first electrode Y.

The voltage Va of the third pulse is a clamped voltage, and the voltage (−Vs+Va) of the fourth pulse is a floating voltage.

A difference between the quantity of light generated by the supply of the positive sustain voltage +Vs" and the quantity of light generated by the supply of the negative sustain voltage −Vs is reduced by setting a difference between the absolute value of the voltage +Vs" of the first pulse and the absolute value of the voltage Va of the third pulse to be substantially equal to a difference between the absolute value of the voltage −Vs of the second pulse and the absolute value of the voltage (−Vs+Va) of the floated fourth pulse. Hence, the uniformity of the quantity of light can be maintained.

As described above, according to an exemplary embodiment, a difference between the quantity of light generated by the supply of the positive sustain voltage and the quantity of light generated by the supply of the negative sustain voltage is reduced by setting a difference between voltages of the first and third electrodes when the positive sustain voltage is supplied to the first electrode during a sustain period to be substantially equal to a difference between voltages of the first and third electrodes when the negative sustain voltage is supplied to the first electrode during the sustain period. Hence, the uniformity of the quantity of light can be maintained.

Embodiments of the invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. A method of driving a plasma display apparatus including a first electrode, a second electrode, and a third electrode positioned in an intersection direction of the first electrode and the second electrode, the method comprising:

alternately supplying a first pulse of a positive polarity direction and a second pulse of a negative polarity direction to the first electrode during a sustain period, an absolute value of a voltage of the first pulse being different from an absolute value of a voltage of the second pulse; and supplying a third pulse of a positive polarity direction to the third electrode during the supply of the first pulse and supplying a fourth pulse having a sum of a voltage magnitude of the third pulse and a voltage magnitude of the second pulse to the third electrode during the supply of the second pulse.

2. The method of claim 1, wherein a difference between the absolute value of the voltage of the first pulse and an absolute value of a voltage of the third pulse is substantially equal to a difference between the absolute value of the voltage of the second pulse and an absolute value of a voltage of the fourth pulse.

3. The method of claim 2, wherein the absolute value of the voltage of the first pulse is substantially two times the absolute value of the voltage of the third pulse.

4. The method of claim 2, wherein the absolute value of the voltage of the third pulse is substantially equal to a voltage of a data pulse supplied to the third electrode during an address period.

5. The method of claim 2, wherein a highest voltage of the third pulse is a voltage obtained by the clamping of the third electrode, and the voltage of the fourth pulse is a voltage obtained by the floating of the third electrode.

6. The method of claim 2, wherein the absolute value of the voltage of the first pulse is two times a voltage of a data pulse supplied to the third electrode during an address period.

7. The method of claim 2, wherein the absolute value of the voltage of the first pulse is smaller than the absolute value of the voltage of the second pulse, and the absolute value of the voltage of the third pulse of the positive polarity direction is one half of the absolute value of the voltage of the first pulse.

8. The method of claim 6, wherein a highest voltage of the third pulse is a voltage obtained by the clamping of the third electrode, and the voltage of the fourth pulse is a voltage obtained by the floating of the third electrode.

9. The method of claim 7, wherein a highest voltage of the third pulse is a voltage obtained by the clamping of the third electrode, and the voltage of the fourth pulse is a voltage obtained by the floating of the third electrode.

10. A plasma display apparatus comprising:

a plasma display panel including a first electrode, a second electrode, and a third electrode positioned in an intersection direction of the first electrode and the second electrode;

a single sustain driver that alternately supplies a first pulse of a positive polarity direction and a second pulse of a negative polarity direction to the first electrode during a sustain period, an absolute value of a voltage of the first pulse being different from an absolute value of a voltage of the second pulse;

an address driver that supplies a third pulse of a positive polarity direction to the third electrode during the supply of the first pulse; and a ground separation controller that switches on or off between a first ground voltage source connected to the single sustain driver and a second ground voltage source connected to the address driver, and controls the supply of the third pulse to the third electrode during the supply of the first pulse and the supply of a fourth pulse having a sum of a voltage magnitude of the third pulse and a voltage magnitude of the second pulse to the third electrode during the supply of the second pulse.

11. The plasma display apparatus of claim 10, wherein a difference between the absolute value of the voltage of the first pulse and an absolute value of a voltage of the third pulse is substantially equal to a difference between the absolute value of the voltage of the second pulse and an absolute value of a voltage of the fourth pulse.

12. The plasma display apparatus of claim 11, wherein the absolute value of the voltage of the first pulse is substantially two times the absolute value of the voltage of the third pulse.

13. The plasma display apparatus of claim 11, wherein the absolute value of the voltage of the third pulse is substantially equal to a voltage of a data pulse supplied to the third electrode during an address period.

14. The plasma display apparatus of claim 11, wherein when the ground separation controller is turned on, a voltage level of the third electrode is clamped to a highest voltage of the third pulse, and when the ground separation controller is turned off, a voltage level of the third electrode is floated to the voltage of the fourth pulse.

15. The plasma display apparatus of claim 11, wherein the absolute value of the voltage of the first pulse is two times a voltage of a data pulse supplied to the third electrode during an address period.

16. The plasma display apparatus of claim 11, wherein the absolute value of the voltage of the first pulse is smaller than the absolute value of the voltage of the second pulse, and the absolute value of the voltage of the third pulse of the positive polarity direction is one half of the absolute value of the voltage of the first pulse.

17. The plasma display apparatus of claim 15, wherein when the ground separation controller is turned on, a voltage level of the third electrode is clamped to a highest voltage of the third pulse, and when the ground separation controller is turned off, a voltage level of the third electrode is floated to the voltage of the fourth pulse.

18. The plasma display apparatus of claim 16, wherein when the ground separation controller is turned on, a voltage level of the third electrode is clamped to a highest voltage of the third pulse, and when the ground separation controller is turned off, a voltage level of the third electrode is floated to the voltage of the fourth pulse.

* * * * *